US010337720B2

(12) United States Patent
Skiba et al.

(10) Patent No.: US 10,337,720 B2
(45) Date of Patent: Jul. 2, 2019

(54) LAMP SAFE SYSTEM

(71) Applicant: Burt Richard Skiba, Mesa, AZ (US)

(72) Inventors: Burt Skiba, Mesa, AZ (US); Mark Evans, Morgan Hill, CA (US)

( * ) Notice: Subject to any disclaimer, the term of this patent is extended or adjusted under 35 U.S.C. 154(b) by 24 days.

(21) Appl. No.: 15/421,129

(22) Filed: Jan. 31, 2017

(65) Prior Publication Data

US 2018/0119943 A1 May 3, 2018

Related U.S. Application Data

(60) Provisional application No. 62/413,506, filed on Oct. 27, 2016.

(51) Int. Cl.

| | |
|---|---|
| ***F21V 33/00*** | (2006.01) |
| ***E05G 1/10*** | (2006.01) |
| ***E05G 1/024*** | (2006.01) |
| ***E05G 1/04*** | (2006.01) |

(52) U.S. Cl.

CPC ..... *F21V 33/0004* (2013.01); *E05G 1/024* (2013.01); *E05G 1/04* (2013.01); *E05G 1/10* (2013.01); *E05Y 2800/106* (2013.01)

(58) Field of Classification Search

CPC ..... F21V 33/0004; F21V 1/00; F21V 21/096; F21V 21/34; E05G 1/024; E05G 1/04; E05G 1/10; F21S 6/002

USPC ..... 109/23, 38, 39, 45, 47, 50, 52, 54, 57, 109/58, 58.5, 59 R

See application file for complete search history.

(56) References Cited

U.S. PATENT DOCUMENTS 1,528,618 A * 3/1925 Knaster ..... A47B 17/04 312/204
1,663,377 A * 3/1928 Knaster ..... A47B 17/03 109/47
3,239,294 A * 3/1966 Lammeyer ..... A47B 85/00 254/122
3,999,493 A * 12/1976 Gulya ..... E05G 1/00 109/23
4,022,137 A * 5/1977 Chiu ..... E05G 1/10 109/44
4,123,978 A * 11/1978 Lentini ..... E05G 1/00 109/51
4,244,303 A * 1/1981 Kurasik ..... A47G 1/06 109/23
4,369,717 A * 1/1983 Bollier ..... E05G 1/00 109/45
4,625,658 A * 12/1986 Hodges ..... E05G 1/00 109/35

(Continued)

*Primary Examiner* — Suzanne L Barrett

(57) ABSTRACT

An embodiment can include a lamp safe system that includes an inner casing and an outer casing, lampshade or lamp body, which can be removably attached to an outer casing though a outer body attachment device. An inner casing can include a first wall, second wall, and third wall that can be removably attached to a safe door. An inner casing can have a male flange. A inner casing can have a door with a lock removably attached. An outer casing can substantially surround an inner casing. An outer casing can have a female flange. An outer casing can have an air spring attached to it through a clevis, which can be attached to an inner casing. A inner casing can slide on alignment track which can be attached to both an inner casing's first wall and third wall, and outer casing inner surface. An electrical system can provide a user with information on a lamp safe system.

19 Claims, 8 Drawing Sheets

(56) References Cited

U.S. PATENT DOCUMENTS

| | | | | | |
|---|---|---|---|---|---|
| 5,048,901 | A * | 9/1991 | DeBlaay | A47B 17/04 | 312/204 |
| 5,066,079 | A * | 11/1991 | Lawrence | E05G 1/00 | 109/54 |
| 5,203,619 | A * | 4/1993 | Welsch | B65G 1/0464 | 312/242 |
| 5,372,076 | A * | 12/1994 | Solt | E05G 1/00 | 109/22 |
| 5,944,396 | A * | 8/1999 | Stephan | A47B 88/80 | 312/204 |
| 6,135,034 | A * | 10/2000 | Clark | E05G 1/00 | 109/45 |
| 6,851,770 | B2 * | 2/2005 | Canedy | A47F 3/002 | 312/114 |
| 8,047,619 | B2 * | 11/2011 | Amstutz | A47F 3/002 | 312/117 |
| 9,091,111 | B2 * | 7/2015 | Popwell | E05G 1/10 | |
| 9,145,728 | B1 * | 9/2015 | LeBlanc | E05G 1/024 | |
| 2016/0145929 | A1 * | 5/2016 | Adrain | E05G 1/026 | 109/50 |

* cited by examiner

LAMP SAFE SYSTEM

CROSS-REFERENCE TO RELATED APPLICATIONS

This Non-Provisional Utility application claims the priority to and benefit under 35 U.S.C. § 119(e) from U.S. Provisional Application No. 62/290,073 titled "Lamp Safe System" and having a filing date Feb. 2, 2016, all of which is incorporated by reference herein.

TECHNICAL FIELD

The present specification relates to a lamp safe system for storing personal items such as guns, jewelry, coins, birth certificates, or other personal items in a safe that looks and functions like a lamp.

BACKGROUND

Various types of devices for storing items safely are known in the art. Usually items such as guns, coins, jewelry, and other valuable personal items can be stored in a safe or a gun box. Typically, a safe is big and bulky that sits in a closet, out in the open that is visible for all to see, hidden in a wall or floor, or hidden in a bookshelf. In addition, a safe can be a small metal or wood container, which lies in the open for anyone who knows its location, which allows for the safe to be easily taken. Usually, a safe's only safety feature is a digital keypad or mechanical dial or keypad, and locking mechanism. Some safes can be bolted to the floor or a wall leaving huge holes in the floor or wall once the safe is removed. Other safes have biometric locks, while other have GPS, or some other type of locating device.

Current technologies include either small or large safes that sit in the open or are hidden that require extensive installation techniques to put into a user's home or place of business. Furthermore, thieves are looking for these types of safes and can easily break into the safes without the owner ever knowing that his/her safe is being stolen, broken into, or tampered with. There is a need for a safe that can be out in the open without anyone knowing that the safe is there, to allow a user to know when the safe is being tampered with, and allow a user to quickly access it in case of an emergency.

SUMMARY

Aspects disclosed herein relates to a lamp safe system for storing items in a safe that can be hidden in a body and function like an item that it is hidden in such as a lamp. A lamp safe system can have a lamp body or lampshade that can surround an inner casing and outer casing. The lamp body or lampshade can be removably connected to the outer casing and can be interchangeable with other outer casings to suit a user's preference. An outer casing can have an inner surface and an outer surface where the outer casing's outer surface can have attachment slots, which an lamp body or lampshade can slid onto and lock into place. An outer casing can have a top and a bottom. An outer casing's bottom can have an opening for an attachment device to be removably attached to the outer casings bottom.

In embodiments a safe can have a door that can be connected to an inner casing. A safe door can have a plurality of locking bolts that can be activated or deactivated by electronics, biometrics, a mechanical operation, or a handle. In certain embodiments a plurality of locking bolts can be activated or deactivated by an electronic switch. A safe door can have a top and a bottom. A safe door top can have an electronic lock, biometric lock, or mechanical lock. In certain embodiments a safe door can have one or more lights removably attached to it. A safe door can have a first wall, a second wall, and a third wall which can extend outwards perpendicularly from the safe door bottom. A first wall, a second wall and a third wall can have a bottom wall extending horizontally connecting the first wall, second wall, and third wall. A first wall and third wall's outside surface can have one or more tracks removably attached to it. A first wall and third wall can have a spring or pneumatic gas spring removably attached to it that can raise and lower the safe door, locking bolts, first wall, second wall, third wall, and bottom wall out of the outer casing. A first wall, second wall, and third wall can a plurality of slots extending horizontally. A plurality of drawers can be slid into a plurality of slots and removably attached. A plurality of drawers can slid in and out with respect to either the first wall and third wall or the second wall and third wall. A plurality or drawers or more than one drawer can be removed from the inner casing to give more space within an inner casing's storage compartment.

An outer casing can have a top section with a female flange. A safe door can have a male flange that can match an outer casing's female flange forming a seal. An inner casing and outer casing can be removably connected to alignment tracks. An inner casing can slide independently of the outer casing on an alignment tracks, rail, or the like. Air springs can be removably connected to an inner casing and an outer casing. Air springs can push an inner casing out of an outer casing. An outer casing can have a battery attached to it, electrical components or an electrical system attached to its inner surface such as, for example, an accelerometer, global position system ("GPS"), microprocessor, transmitting device, microphone, biometrics reader, locking mechanism, Wi-Fi device, USB ports, wireless data exchange, iBeacon, or the like.

In embodiments an outer casing's outer surface can have a plurality of outer body attachment devices, which can removably connect a lamp body or lampshade. A lampshade or lamp body can be interchangeable with plurality of lampshades or lamp bodies. A lamp safe system can be powered by a battery or by alternating current power supply. A battery or an alternating current power supply can power its electrical components such as, for example, a lock, an accelerometer, microprocessor, transmitting device, microphone, biometrics reader, locking mechanism, Wi-Fi device, USB ports, GPS, wireless data exchange, iBeacon, or the like, which can make up an electrical system. If an alternating current power supply is disconnected a battery can power its electrical components.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

DETAILED DESCRIPTION

The embodiments of the invention described herein are not intended to be exhaustive or to limit the invention to precise forms disclosed. Rather, the embodiments selected for description have been chosen to enable one skilled in the art to practice the invention.

Figure 1:
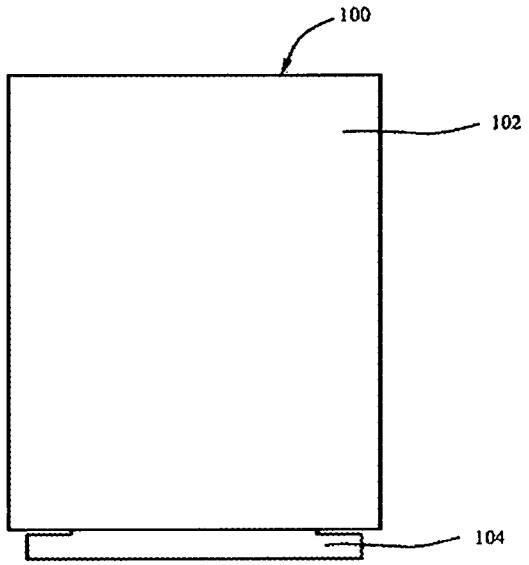
FIG. 1 shows a front view of a lamp safe system in accordance to one, or more embodiments.
Figure 2:
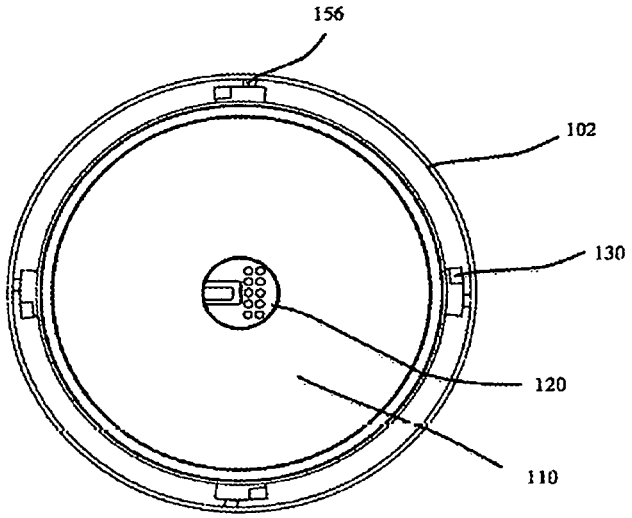
FIG. 2 shows a top view of a lamp safe system in accordance to one, or more embodiments.
Figure 3:
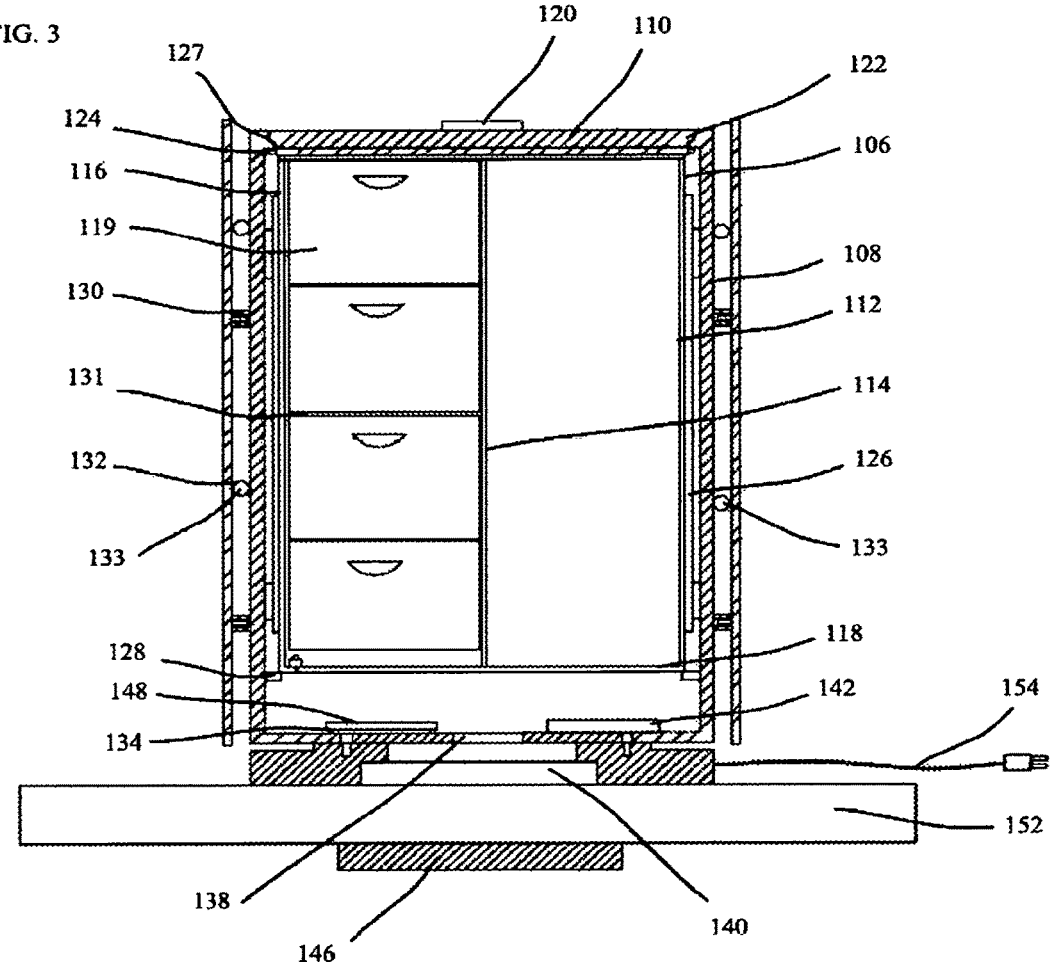
FIG. 3 shows a sectional view of a lamp safe system, in accordance to one, or more embodiments.

Referring initially to FIGS. 1, 2, and 3, a lamp safe system is shown generally at 100. A lamp safe system 100 can have a lampshade 102, a base 104, an inner casing 106, an outer casing 108, and an armature 146.

In embodiments an inner casing 106 can further comprise a safe door 110, a first wall 112, a second wall 114, a third wall 116, and a bottom wall 118. A safe door 106 can comprise of a top and a bottom. A locking system 120 can be removably attached to a safe door's 110 top. A locking system 120 can be electronic, biometric, dial, RF ID, voice or sound activated, wireless data exchange, or the like. In certain embodiments, a locking system 120 can be placed on a base 104, on an outer casing 108, on a lampshade 102, lamp body 302, or the like. A safe door 110 can have a male flange 122 that has a rim that can substantially surround or encompass the outer perimeter of a safe door 110. A safe door 110 can have a plurality of locking bolts 124. Locking bolts 124 can engage a female flange 127, which can keep an inner casing 106 from ejecting out of an outer casing 108. A plurality of locking bolts 124 can be steel, aluminum, high-temperature metal, or the like. A plurality of locking bolts can be round, square, rectangular, semi-circle, or the like. A safe door 110 can be aluminum, steel, ceramic, plastic, high temperature metal, or the like, and it can be insulated. A male flange 122 can be substantially circularly, square, rectangular, or the like in shape. A male flange 122 can be such as, for example, flat, curved, angled, or a combination of each, or the like. A male flange 122 can be such as, for example, lap-joint, slip-on flange, forged flange, bored flange, blank flange, or the like. In certain embodiments, a safe door 110 can be secured by magnetic locks, by locks and pins, by latches, or the like. A sale door 110 can comprise of a means for locking and unlocking a safe door having inner mechanics that can, such as, for example, push and pull locking bolts, power magnetic locks, push and pull locks and pins, push and pull latches, or the like either electronically or by a mechanical combination lock.

Figure 6:
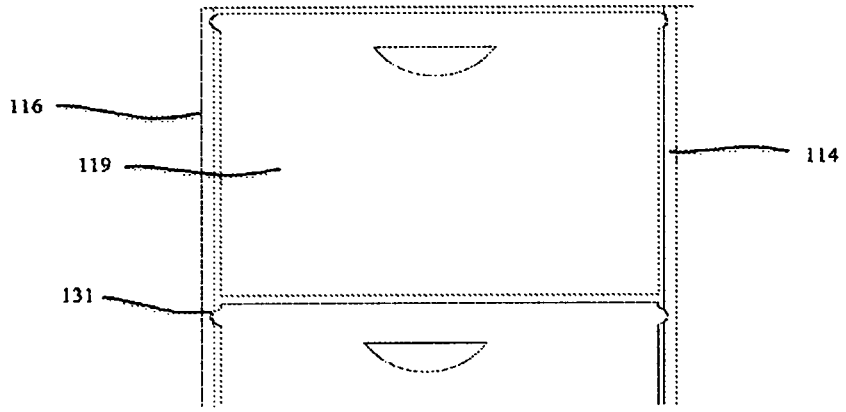
FIG. 6, shows a close-up view of a drawer and plurality of slots, in accordance to one, or more embodiments.

In embodiments a safe door 110 can have a first wall 112, a second wall 114, and a third wall 116 either permanently attached, or removably attached and extending perpendicularly from the safe door's bottom. A first wall 112, a second wall 114, and a third wall 116 can be aluminum, steel, plastics, metals, PTFE, or the like. A first wall 112, a second wall 114, and a third wall 116 can have a thickness of such as, for example, 0.05 inches, 0.125 inches, 0.25 inches, 0.5 inches, 0.75 inches, 1.0 inches, 1.125 inches, 1.25 inches, 1.5 inches, 1.75 inches, 2.0 inches, or the like. A second wall 114, and a third wall 116 can have a plurality of slots 131 that can extend horizontally along and on an inner surface of a third wall, and can extend along a first or second surface of a second wall as shown in FIG. 6. A plurality of drawers 119 can be slid into a plurality of slots 131. In certain embodiments a plurality of drawers 119 can be removed from a plurality of slots 131 leaving an empty space for extra storage between a second wall 114 and a third wall 116.

In certain embodiments a first wall 112, and a second wall 116 can have a plurality of slots 131 that can extend horizontally along and on an inside surface of a first wall, and can extend along a first or second surface of a second wall. A plurality of drawers 119 can be slid into a plurality of slots 131. In certain embodiments a plurality of drawers 119 can be removed from a plurality of slots 131 leaving an empty space for extra storage between a first wall 112 and a second wall 114, or a third wall 116, and a second wall. In certain embodiments a plurality of hooks (not shown) can be removably attached to a first wall's inner surface, and/or second wall's inner or outer surface, and/or third wall's inner surface. In certain embodiments a first wall 112, and a third wall 116 can be flat, circular, rectangular, square, or the like to fit a user's preference and to fit an outer casing's shape.

In embodiments a first wall 112, a second wall 114, and a third wall 116 can have a bottom wall 118 extending perpendicular along a first wall, a second wall, and a third wall's lower edge. A bottom wall 118 can be removably connected or permanently connected to a first wall, a second wall, and a third wall's lower, bottom edge by such as, for example, bolts and threaded holes, welds, clamps, or the like. In embodiments a bottom wall 118 can have a slot, or a hole 138 placed along its such as, for example, front edge, middle area, back edge, or the like. In an alternative embodiment a bottom wall 118 does not have a hole or slot.

In alternative embodiment a safe door 110 can have two or more walls extending perpendicularly from a safe door 110 bottom and two or more walls can be either permanently attached to, or removably attached to it. Two or more walls can be such as, for example, two, three, four, five, six, seven, eight or the like. Two or more walls can have a plurality of slots for drawers to be removably inserted into. In addition, two or more walls can have hooks removable attached to it, or a holster removably attached, or pockets removably.

In embodiments a first wall 112 and a third wall 116 can have one or more alignment tracks 126 removably attached to a first wall and a third walls outer surfaces. Alignment tracks 126 can be removably attached to an outer casing's 108 inner surface. There can be such as, for example, one alignment track, two alignment track, three alignment tracks, four alignment tracks, or the like. An alignment track 126 can be a slider, a roller and guide, rods and pistons, telescopic slide, pin and guide, or the like. Alignment tracks 126 can keep an inner casing 106 centered, and/or aligned to an outer casing 108. Alignment tracks 126 can allow an inner casing 106 to raise and/or lower in and out of an outer casing 108. In certain embodiments an alignment track 126 can be replaced with one or more tracks attached on an outer casing 108, and one or more guidance pins attached on an inner casing 106. In alternative embodiment an alignment track can be removable connected and placed substantially horizontally onto an inner casing 106 and an outer casing 108. An inner casing 106 can eject horizontally from an outer casing 108. A lampshade 102 or lamp body 302 can have a window that can open and close as an inner casing 106 is ejected out of an outer casing 108. In certain embodiments an alignment track 126 can be omitted.

In embodiments an outer casing 108 can further comprise a female flange 127, a plurality of support prongs 128, an outer body attachment device 130, a light attachment 132, and two or more electrical board insulators 134. An outer casing 108 can have exist ports cut, or drilled into it to allow wires for one or more lights 133 and the light's wiring, Wi-Fi antenna, GPS antenna, i-Beacon antenna, to allow electrical signal to escape from an outer casing, or the like. In embodiments an outer casing 108 can be circular, square, rectangular, triangular, or the like in shape.

An outer casing's 108 female flange 127 can substantially interact and/or can interconnect with an inner casing's 106 male flange 122 having space between the edges of a male flange and a female flange to allow the an inner casing 106 to raise out of a outer casing 108. A female flange 127 can be such as, for example, flat, curved, angled, and/or a combination of each, or the like. A female flange 127 can be substantially circularly, square, rectangular, or the like in shape. A female flange 127 can be lap-joint, slip-on flange, forged flange, bored flange, blank flange, or the like. An outer casing 108 can have walls that extend vertically from a female flange 127 forming a radius, or sharp corner having a bottom that can substantially surround an inner casing 106. An outer casing 108 wall thickness can be such as, for example, 0.125 inches, 0.25 inches, 0.5 inches, 0.75 inches, 1.0 inches, 1.125 inches, 1.25 inches, 1.5 inches, 1.75 inches, 2.0 inches, or the like. An outer casing 108 can be aluminum, steel, plastic, ceramic, Teflon, or the like. In addition, a outer casing 108 can be layers such as, for example, one layer can be mild steel and another layer can be hardened steel, or one layer can be aluminum, and the other layer can be hardened steel, or the like. An outer casing can have one or more layers such as, for example, one layer, two layers, three layers, four layers, five layers, or the like to vary the outer casings thickness, toughness, and durability. In certain embodiments an outer casing 108 can have a layer of insulation with such as, for example, high temperature thermal insulation, high temperature fabrics, or the like.

In embodiments an outer casing 108 can have attachment points for a base 104. A base 104 can be such as, for example, circular, square, rectangular, triangular, hexagonal, any combination of shape, or the like. A base 104 can be removably attached to an outer casing 108 by bolts, or it can be screw directly onto an outer casing, or it can be welded onto an outer casing, or the like. A base 104 can have a plurality of cut outs, and/or plurality of holes spaced throughout to allow for attaching a base onto a outer casing 108, a table or night stand 152, a desk mount security anchor point, or the like. In certain embodiments a plurality of cut outs, and/or thru holes can be for screws to attached a desk, nightstand, or the like. In certain embodiments a base can be connected to a table, a night stand or any other surface by bolts and nuts, by a cable and lock system, by a magnet and aperture system, or the like.

In embodiments a base 104 can have a hole for a magnet 140 to be removable attached to the base. A magnet 140 can be an electro-magnet, rare-earth magnet, permanent magnet, or the like. In certain embodiments magnet 140 can have an on/off switch located on an inner casing's bottom wall 118, or on an inner casing's first wall 112, or second wall 114, or third wall 116. An electromagnet can be attached to a battery and to a power supply that can be plugged into a wall socket. A battery 142 can power an magnet 140 during a power outage, such that the magnet can stay active and attached to and connected through an armature 146 a nightstand or desk during a power outage. A magnet 140 can have an armature 146 that can be attached through a barrier or on the opposite side of a desk or nightstand's wall that when a magnet is active, the armature and magnet hold the safe assembly tightly onto the desk or nightstand's top.

In embodiments a battery 142 can power a safe system's electrical system 148 such as, for example, an accelerometer, global position system, microprocessor, transmitting device, microphone, locking mechanism, biometrics reader, Wi-Fi device, USB ports, or the like, during a power outage, or during the lamp safe systems temporary removal and relocation. A power supply (not shown) can power a safe systems electrical system such as, for example, an accelerometer, GPS, microprocessor, transmitting device, microphone, biometrics reader, lock mechanism, Wi-Fi device, USB ports, GPS antenna, or the like, during normal operation such as when it is plugged into a wall socket through a extension plug 154.

In embodiments an outer casing 108 can further comprise a plurality of support prongs 128. A plurality of support prongs 128 can be attached to an outer casing's 108 inner surface by such as, for example, press fit, welded, screwed in, or the like. A plurality of support prongs 128 can be dowel pins, rubber pads, standoffs, headed pins, or the like. In certain embodiments a plurality of support prongs 128 can substantially surround and support an inner casing 106.

Figure 4:
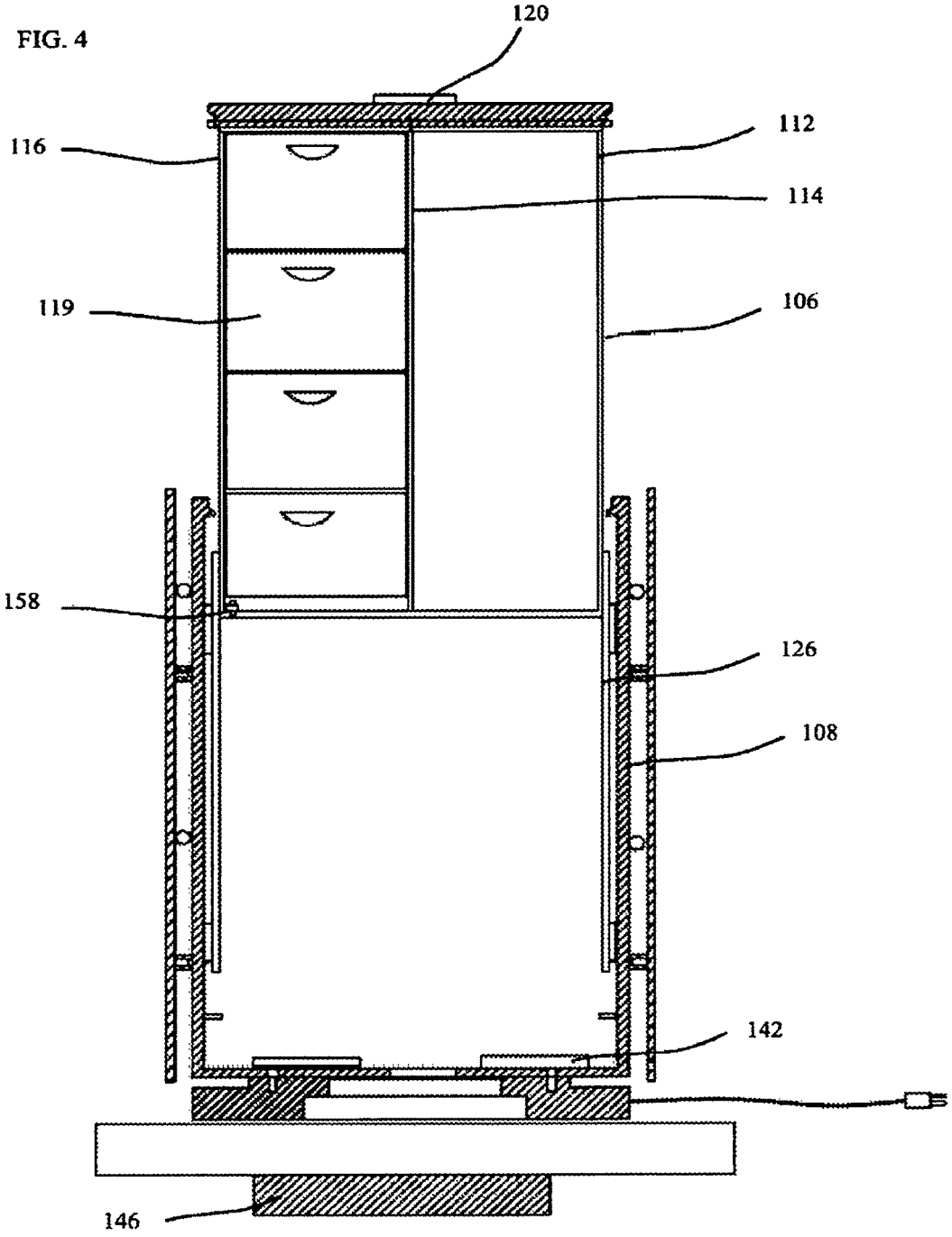
FIG. 4 shows a sectional view of a lamp safe system with a inner casing in its open position, which is raised of an outer casing, in accordance to one, or more embodiments.
Figure 5:
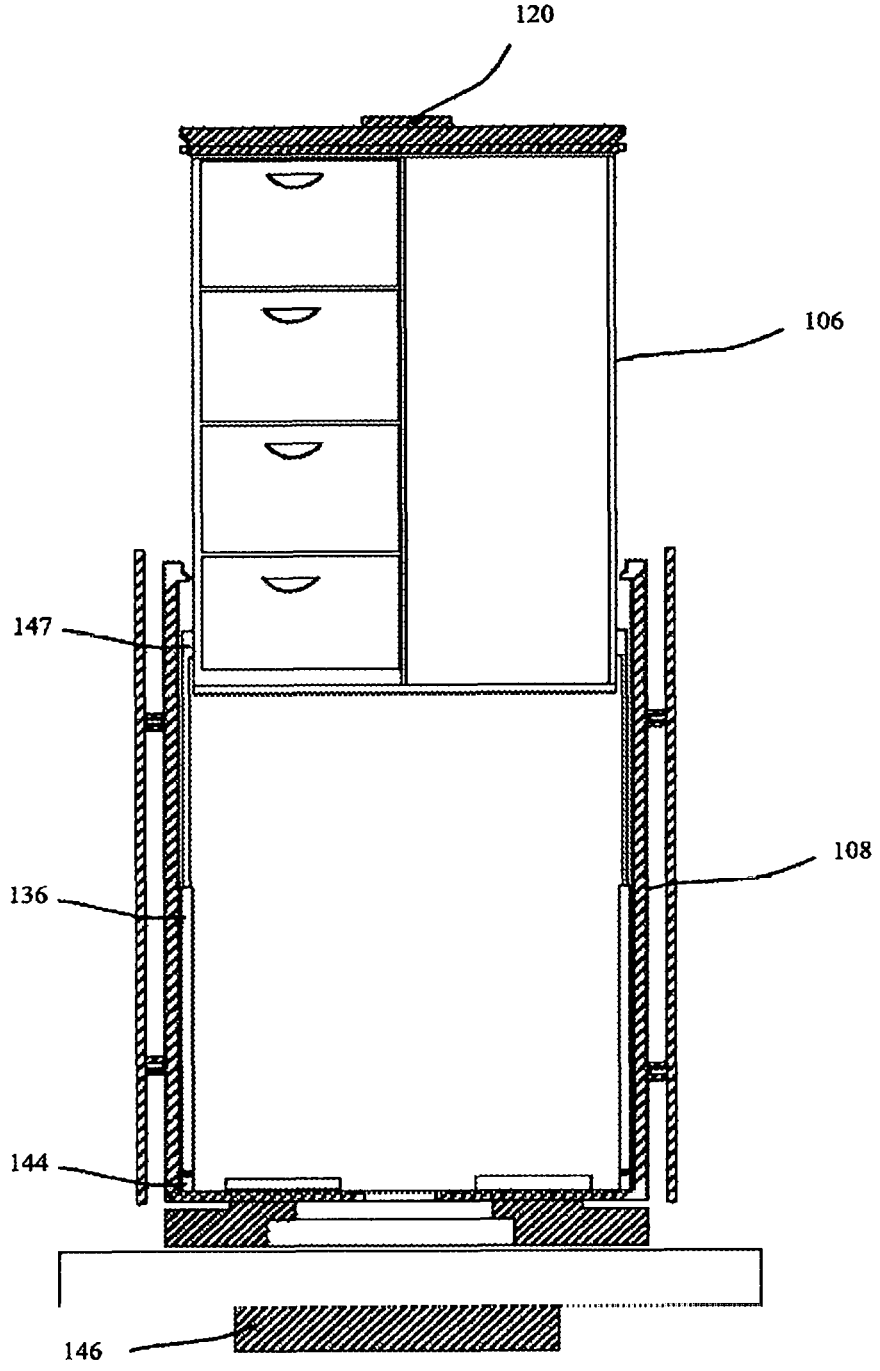
FIG. 5, shows another sectional view of a lamp safe system with a inner casing in its open position, raised out of an outer casing, showing air springs, in accordance to one, or more embodiments.

Referring to FIG. 4 and FIG. 5, a view a cross-sectional view of a lamp safe system, and a cross-sectional view of a lamp safe system with a inner casing in its open position, raised out of an outer casing, showing air springs. In embodiments, an inner casing 106 can substantially rise out of and lower down into an outer casing 108. In certain embodiments, an inner casing 106 can eject out of a side of an outer casing 108. An inner casing 106 can be pushed out of an outer casing 108 by one or more lifting springs 136 such as, for example, springs, gas springs, air springs, pneumatic lift system, or the like. A lifting spring 136 can vertically push an inner casing 106 out of an outer casing 108, or a lifting spring can horizontally push an inner casing out of an outer casing. A lifting spring 136 can be removably connected to a bottom of an outer casing 108, or to an inner side of an outer casing by a clevis 144 such as, for example, a clevis and pin, clevis brackets, threaded rod, pivot brackets, welded directly to outer casing inner body, or the like. A lifting spring 136 can be removably attached to an inner casing's first wall 112 and third outside walls 116 by a lifting bracket 147. A lifting bracket 147 can be removably attached to a first and third outside walls by such as, for example, using a bracket bolted into a first and third wall 116, pinning the bracket onto a first and third wall, having a connection point on a lifting spring 136 and a first and third walls that can slide and lock onto the inner casing while allowing it to be released from the inside walls of the inner casings first and third walls, or the like. In an alternative embodiment, an inner casing 106 can be lifted out of an outer casing 108 by using counter weights (not shown) with a pulley system. The counter weights can have a natural position where the inner casing 106 is raised out of the outer casing 108. In another alternative embodiment, an inner casing 106 can be lifted out of an outer casing 108 by a motor, gears, and screw. A screw can be an Acme Screw, or the like. In another embodiment, an inner casing 106 can be manually ejected out of an outer casing 108 by pulling on a handle (not shown) attached to a safe door 110.

In certain embodiments one or more electrical cables (not shown) can be connected to a locking system 120 and a battery 142, where an electrical cable can be coiled and uncoiled as the inner casing 106 lifts out of an outer casing 108. In addition, art electrical cable can be connected to a switch 158 that can turn on/off a magnet 140. In another embodiment, an inner casing 106 can be in electrical contact with such as, for example, an outer casing 108, an alignment track 126, a lifting spring 136, or the like such that the circuit can be complete and a battery or AC power source can power a locking system 120. An electrical contact can be active in a fully closed position, or a fully open position, or can have a continuous contact through the whole length, while an inner casing 106 is being raised out the outer casing 108. In yet another embodiment a electrical switch (not shown) can be turned on/off when an inner casing raises out of an outer casing, turn on and off one or more lights (not shown) connected to a safe door's 110 bottom, and an electrical switch can engage an alarm alerting a user of an intruder if a locking system 120 is not properly disengaged.

Figure 8:
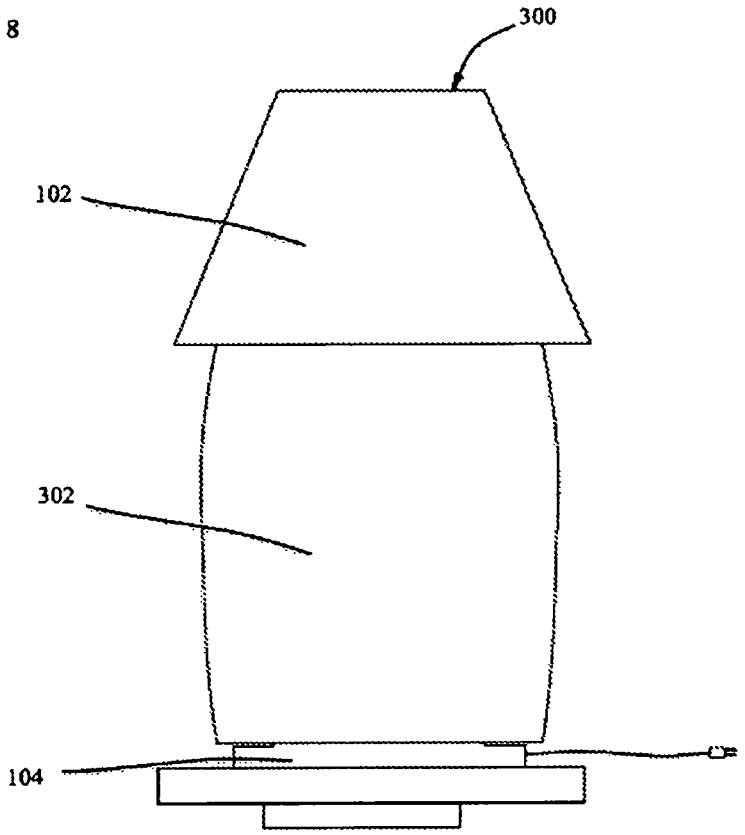
FIG. 8 front view of another embodiment of lamp safe system in accordance to one, or more embodiments.
Figure 9:
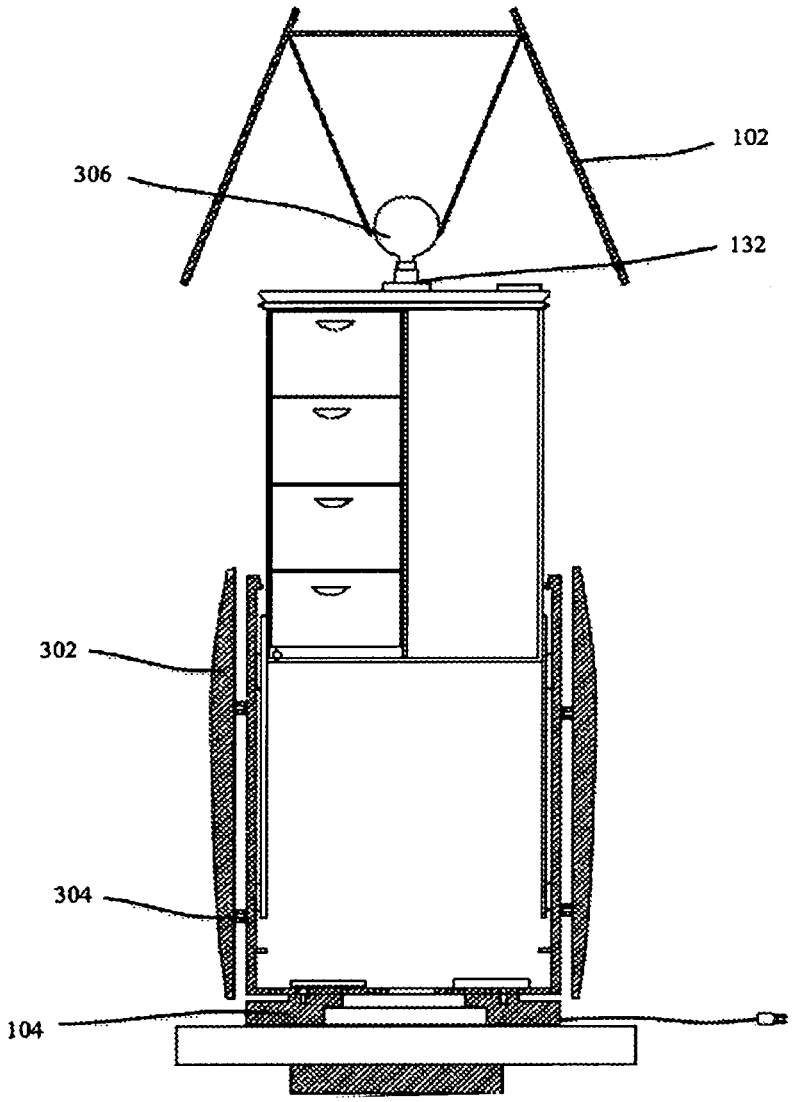
FIG. 9 shows a sectional view of another embodiment of lamp safe system with the inner casing in its open position, in accordance to one, or more embodiments.

Referring to FIG. 8, and FIG. 9 a front view and a cross-sectional view of an alternative embodiment of a lamp safe system shown general at 300. In embodiments, a lamp safe system can have a lamp body 302 that can be removably attached to an outer casing 108 through an plurality of outer body attachment device 130. An lamp body 302 can be made of such as, for example, brass, steel, aluminum, ceramic, wood, plastics, plaster, pottery, or the like. A lamp body 302 can have an outer surface that can be a variety of shapes such as, for example, circular, spherical, hexagonal, triangular, rectangular, or any combination of shapes, or the like. A lamp body 302 can have an inner surface that can be larger in size than an outer body attachment device 130. A lamp body 302 can further comprise a plurality of connection prongs 304 which can be lined up with a plurality of outer body attachment devices 130. A lamp body 302 can be slid over an outer casing 108 and removably attached to an outer body attachment device 130 by sliding an outer body and locking it into place with a plurality of connection prongs 304. A connection prong 304 can be attached to a lamp body 302 by such as, for example, welding, bolting, gluing, or the like. A connection prong 304 can be a dowel pins, spring pins, plug gauges, spring plungers, spring dowel pins, quick release pins, locking pins, or the like.

In embodiments, a light 306 can be attached to the top of a safe door 110 by the one or more light holders 132 wherein a light holder can be, for example, a lamp socket, or the like. A lampshade 102 can be removably attached to a light holder, lamp socket, safe door, or light as shown in FIGS. 8 and 9, or the like. A lock can be removable attached to a safe door's top surface at such as, for example, at an inner portion, at an outer portion, or the like.

Figure 7:
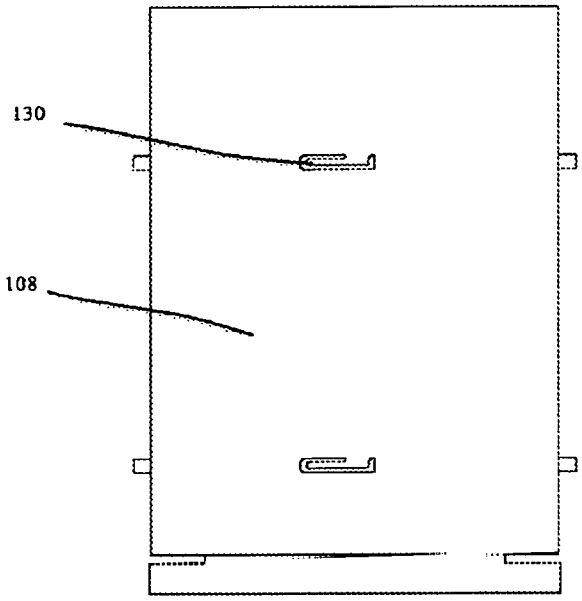
FIG. 7 shows an outer casing with a lampshade omitted of a lamp safe system, in accordance to one, or more embodiments.

Referring to FIG. 2, and FIG. 7 a top view of a lamp safe system, and a side view with a lampshade 102 or a lamp body 302 removed. In embodiments a lamp body 302 or a lampshade 102 can be removably attach to an outer casing 108 through an outer body attachment device 130. An outer body attachment device 130 can further comprise a plurality of slotted connections. A slotted connection can have an upper and lower portion, and an outer and inner portion. A slotted connection's inner portion can be attached to an outer casing's 108 outer surface, and can be spaced on an upper portion of an outer casing, and/or a lower portion of an outer casing's 108 outer surface. In certain embodiments an outer body attachment device 130 can be located on a middle portion of an outer casing's 108 outer surface. A slotted connection's inner portion can be attached to an outer casing's 108 outer surface by such as, for example, welded, bolted, glued, spot welded, tacked, or the like. A slotted connection can be such as, for example, bars, key stocks, tubes, u-channels, rods, or the like. A slotted connection can be such as, for example, plastics, teflon, iron, lead, steel, aluminum, fiberglass, ceramic, or the like. A slotted connection upper portion can have a small slot the can extend from one side of a slotted connection to about half the distance to the other end of a slotted connection. A slotted connection's outer portion can have a slot that can extend from about one side of a slotted connection to about the other side of a slotted connection leaving a wall thickness on both sides.

In embodiments a lamp safe system 300 can have a lamp body 302 which can be removably attached to an outer body attachment device 130. A lamp body 302 can slid over an outer casing 108. A lamp body 302 can be such as, for example, circular, square, triangular, hexagonal, or any combination of shapes, or the like. A lamp body 302 can be a plastic, fabric, paper, metal, ceramic, pottery, or the like. In certain embodiments where a lamp body 302 can further comprise a plurality of connection prongs 156, which can be lined up with a plurality of outer body attachment devices 130. A lamp body 302 can be slid over an outer casing 108 and removably attached to an outer body attachment device 130 by sliding a lamp body and locking it into place with a plurality of connection prongs 156. A connection prong 156 can be attached to a lamp body 102 by such as, for example, welding, bolting, gluing, or the like. A connection prong 156 can be a dowel pins, spring pins, plug gauges, spring plungers, spring dowel pins, quick release pins, locking pins, or the like. A lampshade 102 can be removably connected to a light 306 wherein a light can be attached to the one or more light holders 132, which can raise and lower with an inner casing 106 as the inner casing is raised in and out of an outer casing 108.

In certain embodiments a lamp body 302 can cover a base 104 such that the lamp body can support an outer casing 108, and inner casing 106. In another embodiment a base 104 can be apart of an outer casing 108, or it can be apart of a lamp body 302 making one piece. In embodiments a plurality of USB connection ports can be removably attached into a base 104, a lamp body 302, or an outer casing 108.

In embodiments an electrical system 148 can link to a user's phone or computer through Wi-Fi, iBeacon, wireless data exchange, or the like. A electrical system's 148 components can recognize when a lamp safe system 100 is being shaken, removed from its location, unplugged, pried open, or the like. An electrical system's 148 components can send its location to a user's phone or computer. In addition a electrical system can have a hard drive to store user's information. An electrical system's 148 components can recognize a user's biometrics. An electrical system can send data to a user's phone or computer relaying information such as, for example, who has opened the lamp safe system, how many times the lamp safe system has been open, whether the lamp safe system has been shaken or disturbed in any way. In addition an electrical system can store user's information, and personal information keeping data, and pictures safe.

Figure 10:
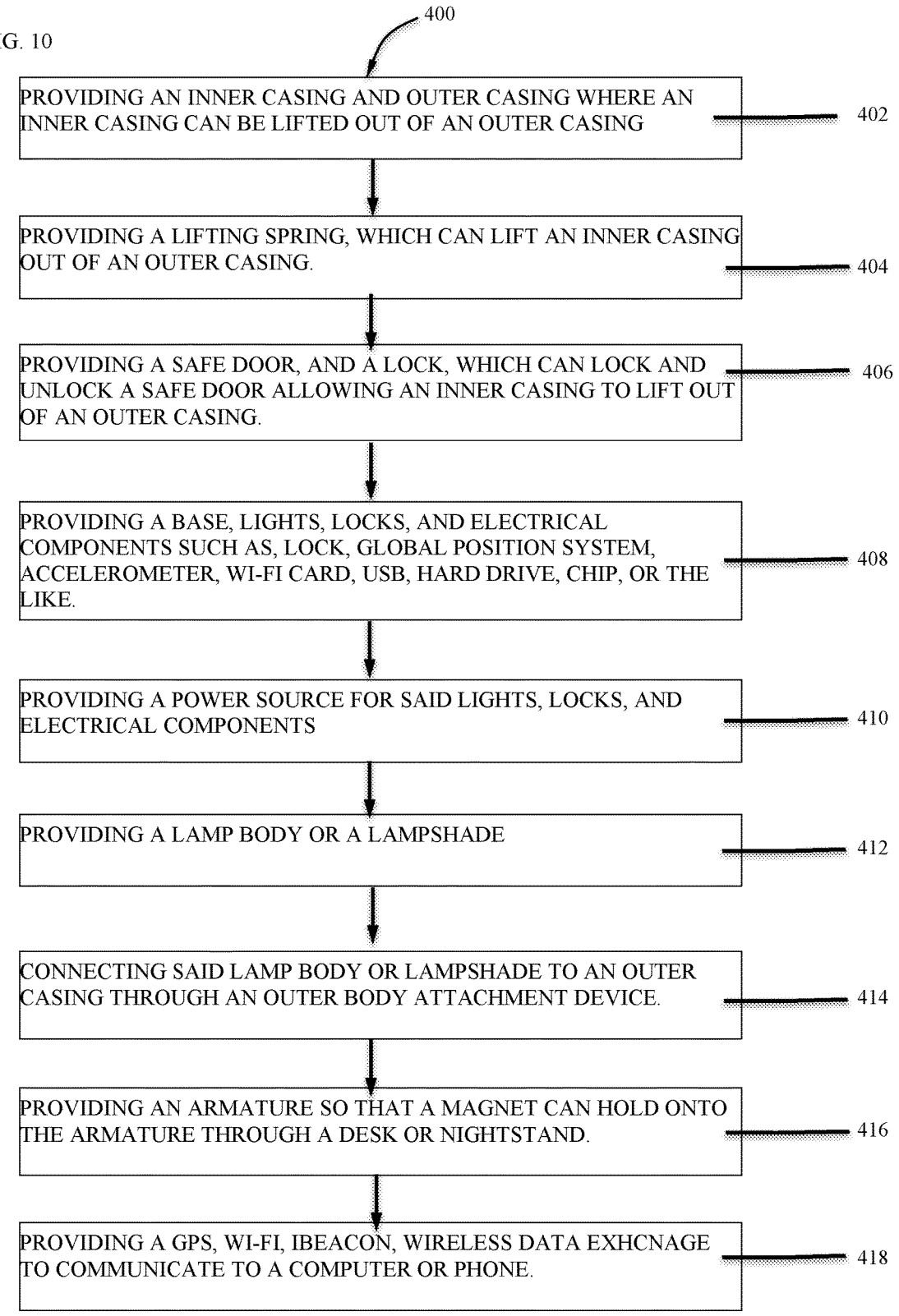
FIG. 10 is a block diagram of an exemplary method of manufacturing of a lamp safe system, in accordance with one or more embodiments.

Referring to FIG. 10, a block diagram illustrating an exemplary method 400 associated with manufacturing a lamp safe system. As a preliminary step to one variant of the exemplary embodiment can include providing lamp safe system components as described herein. At step 402, providing an inner casing and outer casing where an inner casing can be lifted out of an outer casing. At step 404, providing a lifting spring, which can lift an inner casing out of an outer casing. At step 406, providing a safe door and a lock, which can lock and unlock a safe door allowing an inner casing to lift out of an outer casing. At step 408, providing base, lights, locks, and electrical components. At step 410, providing a power source for said lights, locks, and electrical components. At step 412, providing a lamp body or lampshade. At step 414 connecting said lamp body or lampshade to an outer casing through an outer body attachment device. At step 414, providing an attachment mechanism such as magnet to a base. At step 416, providing an armature so that a magnet can hold onto it through a desk, or nightstand. At step 418, providing GPS, Wi-Fi, iBeacon, wireless data exchange to communicate to a computer or phone. In certain embodiments, a lock 120 can be placed on a base 104, on an outer casing 108, on a lampshade 102, lamp body 302, or the like.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of the present disclosure, which is defined solely by the claims. Accordingly, embodiments of the present disclosure are not limited to those precisely as shown and described.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the disclosed embodiments (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the embodiments otherwise claimed. No language in the present specification should be construed as indicating any non-claimed element essential to the practice of the disclosed embodiments.

EXAMPLES

The following non-limiting examples are provided for illustrative purposes only in order to facilitate a more complete understanding of representative embodiments. These examples should not be construed to limit any of the embodiments described in the present specification including those pertaining to the method of correcting pectus carinatum.

Example 1

Safely Locking Away Personal Items

In a lamp safe system, a user can put items such as, rings, necklaces, coins, etc. in the drawers, and on hooks within the inner casing of a lamp safe system. A user can push down the inner casing into an outer casing where a female flange and a male flange touch, and a lock engages locking an inner casing down into an outer casing. Once the lamp safe system is locked, the accelerometer is turned on allowing the user to receive information on his/her computer or phone whether the lamp safe system is moved, or shaken. A lamp safe system can be removably attached through a magnet and armature to a night stand or desk keeping the lamp safe system securely attached to a desk, nightstand, or the like.

A user can place his/her hand on a biometrics reader or lock that can disengage a lock releasing the inner casing and ejecting it out of an outer casing body. In addition, a biometrics reader, switch, or lock can disengage the accelerometer when the inner casing ejects out of an outer casing. If a thief comes into a room where the lamp safe system is located, the thief can only see a lamp and not a safe keeping the valuable items safe inside.

Example 2

Quick Access to Gun in Emergency

In a lamp safe system, a user can put a gun inside an inner casing. The inner casing can be pushed down an outer casing keeping the gun safe inside. If a user needs a gun in an emergency, the inner casing can quickly be ejected out of the outer casing by biometrics or a lock on lamp safe system. If somebody tries shaking the safe or tries opening the safe, an accelerometer in connection with an electrical system, can send a message through an application on a user's phone that the lamp safe system is being shaking or opened without the user's permission.

What is claimed is:

1. A lamp safe system, said system comprising:

an inner casing comprising a safe door, wherein said safe door is configured to attached to said inner casing wherein said inner casing further comprises a male flange;

an outer casing comprising an outer wall and an inner wall wherein said inner wall is attached to a plurality of alignment tracks wherein said plurality of alignment tracks are connected to said inner casing;

a locking system, wherein said locking system is attached to said safe door;

a plurality of lifting springs, a plurality of lifting brackets, and a plurality of clevises wherein said lifting springs can push said inner casing out of said outer casing, wherein said lifting springs can be removably connected to said outer casing by said plurality of clevises, wherein said lifting spring is removable connected to said inner casing and said lifting brackets;

a light wherein said light is attached to one or more light holders;

a lampshade a base wherein said base is attached to said outer casing;

a lamp body; and an armature.

2. A lamp safe system as set forth in claim 1, wherein said outer casing further comprises a female flange, a plurality of outer body attachment devices, and two or more electrical board insulators.

3. A lamp safe system as set forth in claim 2, wherein said outer casing and said female flange can substantially interconnect with said inner casing's said male flange.

4. A lamp safe system as set forth in claim 2, wherein said lamp body or said lampshade are removably attached to said outer body attachment devices, or said lampshade is removably attached to said light.

5. A lamp safe system as set forth in claim 1, wherein said outer casing includes a plurality of support prongs.

6. A lamp safe system as set forth in claim 5, wherein said plurality of support prongs are attached to said outer casing's said inner wall, wherein said support prongs substantially surround said inner casing.

7. A lamp safe system as set forth in claim 1, wherein said base can further comprise a magnet, wherein said magnet is removably attached to said armature through a barrier.

8. A lamp safe system as set forth in claim 1, wherein said locking system is a mechanical or digital lock.

9. A lamp safe system as set forth in claim 1, wherein said lifting springs are gas or air springs.

10. A lamp safe system as set forth in claim 1, wherein said lamp safe system can further comprise an accelerometer, a global position system ("GPS"), a microprocessor, a transmitting device, a microphone, a biometrics reader, a locking mechanism, a Wi-Fi device, a USB port, and a wireless data exchange system.

11. A lamp safe system as set forth in claim 10, wherein said wireless data exchange system connects to said lamp safe system to a computing device through Wi-Fi, Bluetooth, and/or Bluetooth Low Energy.

12. A method of use for a lamp safe system, which comprises:

providing an inner casing and an outer casing wherein said inner casing ejects out of said outer casing; providing a lifting spring, and a lifting bracket, wherein said lifting spring is attached to said inner casing by one or more points, and ejects said inner casing out of said outer casing;

providing a safe door, and a plurality of locking bolts wherein said plurality of locking bolts are attached to said safe door, and said plurality of locking bolts latch said safe door shut, or unlatch said safe door allowing said inner casing to eject out of said outer casing;

providing a base, one or more lights, a plurality of connection prongs, an electrical system which comprises a digital lock, a global positioning system, a accelerometer, a Wi-Fi system, a USB port, a hard drive, and a microprocessor;

providing a power source for said plurality of lights, said plurality of locking bolts, and said electrical components;

providing a lamp body;

providing a lampshade;

connecting said lamp body, or said lampshade to an outer casing through said outer casing, and an outer body attachment device;

providing a base to hold a magnet and said lamp safe system to a nightstand through a armature; and connecting said global positioning system, said Wi-Fi, an iBeacon, to a wireless data exchange to communicate to a computer or a phone.

13. A method of claim 12, wherein said digital lock activates said locking bolts wherein said locking bolts are released.

14. A method of claim 12, wherein said inner casing and said safe door are configured to eject out of said outer casing by said lifting brackets, when said lifting springs and said locking bolts are released.

15. A method of claim 12, wherein said lifting springs eject said outer casing, said safe door, and said locking out of said inner casing.

16. A method of claim 12, wherein said lamp body is placed over and connected to said outer casing.

17. A method of claim 16, wherein said lamp body can be removed and replaced with a different type of lamp body.

18. A lamp safe system as set forth in claim 1, wherein said one or more light holder is attached to said safe door or said outer casing.

19. A lamp safe system as set forth in claim 1, wherein said light is a plurality of lights attached to said the one or more light holder wherein said light holders are attach to the outer casing or safe door.

* * * * *